US005399102A

United States Patent [19]

Devine

[11] Patent Number: 5,399,102

[45] Date of Patent: Mar. 21, 1995

[54] BREAKAWAY EXTENSION CORD FOR PREVENTING ELECTRICAL PLUG DAMAGE

[76] Inventor: Michael J. Devine, 9328 Kessler La., Overland Park, Kans. 66212

[21] Appl. No.: 233,224

[22] Filed: Apr. 26, 1994

Related U.S. Application Data

[63] Continuation-in-part of Ser. No. 155,382, Nov. 22, 1993, abandoned.

[51] Int. Cl.[6] ..... H01R 11/00

[52] U.S. Cl. ..... 439/505; 439/180

[58] Field of Search ..... 439/173, 180, 222, 223, 439/369, 502, 503, 505, 932

[56] References Cited

U.S. PATENT DOCUMENTS 4,077,690 3/1978 Koether ..... 439/180

4,900,270 2/1990 Edwards et al. ..... 439/502

*Primary Examiner*—Khiem Nguyen

*Attorney, Agent, or Firm*—Hovey, Williams, Timmons & Collins

[57] ABSTRACT

A short electrical extension cord (10) is provided which is designed for use with large, mobile appliances (30) such as carpet shampooers or the like, in order to prevent damage to the male plug or electrical connector (34) forming a part of the appliance (30). The short extension cord (10) includes a short stretch of electrical cable (12) with a female electrical receptacle (16) and male electrical connector (18) operatively coupled to the cable stretch (12) adjacent the opposed ends thereof. In use, the male connector (18) is inserted into a stationary receptacle outlet (40), and the appliance male electrical connector (34) is inserted into female receptacle (16). In use of the appliance (30), the flexibility of cable stretch (12) assures that, in the event that an undue tension load is placed on appliance power cord (32), a separation occurs between appliance male electrical connector (34) and short extension cord female receptacle (16) prior to any damage to the male electrical connector (34).

1 Claim, 1 Drawing Sheet

BREAKAWAY EXTENSION CORD FOR PREVENTING ELECTRICAL PLUG DAMAGE

This application is a continuation-in-part of application Ser. No. 08/155,382, filed Nov. 22, 1993, now abandoned.

BACKGROUND OF THE INVENTION

1. Field of the Invention

The present invention is broadly concerned with a simple yet highly effective apparatus and method for preventing damage to male electrical plugs, and particularly those forming a part of power cords of mobile appliances such as carpet cleaning devices or floor sanders. More particularly, the invention pertains to the use of a relatively short electrical extension cord presenting opposed female and male electrical connection ends; the male end of the short extension cord is inserted into a normal wall receptacle, whereas the male plug of the appliance power cord is inserted into the female end of the short electrical extension cord. In this fashion, if an undue tension loading is placed on the appliance power cord, a separation between the male plug and female end of the short extension cord occurs prior to any damage to the electrical connectors.

2. Description of the Prior Art

Carpet shampooing devices are in the form of large, heavy, mobile cleaning appliances having an elongated (e.g., 25–100 feet) electrical power cord equipped with a male electrical connector or plug at the free end thereof. In use, an appliance of this type is plugged into a normal stationary wall receptacle, and carpet cleaning operations performed. It often occurs, however, that during the course of carpet cleaning, the appliance will be moved around corners and in other remote locations relative to the electrical receptacle. Often, the user inadvertently stretches the electrical cable to its maximum length and places an undue tension load on the power cable. This can cause the plug to be pulled at an angle relative to the electrical receptacle, thereby imposing a bending movement leading to damage of the male plug. When this occurs, it is necessary to sever the original, damaged plug from the end of the power cord, and replace it with a new plug. This is not only time-consuming, but such field-applied electrical plugs often lack the insulative integrity of the original factory-installed plug.

Professional carpet cleaners report that this problem of damage to electrical plugs is quite common, and indeed may occur several times in a given week.

Therefore, there is a need in the art for an improved method and apparatus which prevents significant damage to the male connector plug forming a part of a mobile appliance, and particularly floor-working appliances such as carpet shampooers or floor sanders.

SUMMARY OF THE INVENTION

The present invention overcomes the problems outlined above, through provision of supplementary electrical connection means including, and more preferably consisting essentially of, short extension cord for preventing electrical plug damage. Broadly speaking,the extension cord of the invention includes a stretch of flexible electrical cable having first and second ends, with a female electrical receptacle operatively coupled with the first end of the cable. A male electrical connector adapted for insertion into a normal, stationary electrical outlet receptacle is operatively coupled with the second end of the cable. Very importantly, the short extension cord should have a maximum length of up to about 12 inches, and more preferably up to about 8 inches.

In use, the male connection end of the short extension cord is inserted in the usual fashion into a stationary wall outlet receptacle, and the male electrical connector forming a part of the appliance power cord is inserted into the female receptacle of the short extension cord. Use of the appliance can then proceed in the usual fashion. However, if an undue tension loading is placed on the appliance cord by virtue of inadvertent stretching or pulling thereof, a separation between the appliance power cord and short extension cord occurs before any damage to the electrical connectors making up the combined device. Furthermore, this separation occurs before any damage is sustained by the stationary wall receptacle. That is to say, the flexibility of the short extension cord insures that the male electrical connector of the appliance remains substantially aligned with the female receptacle of the short extension cord. This in turn insures that a clean, damage-free separation occurs at this juncture, rather than inducing potentially damaging bending movements on the electrical connectors.

DETAILED DESCRIPTION OF THE PREFERRED EMBODIMENTS

Figures 1, 2, 3, 4, 5, 6:
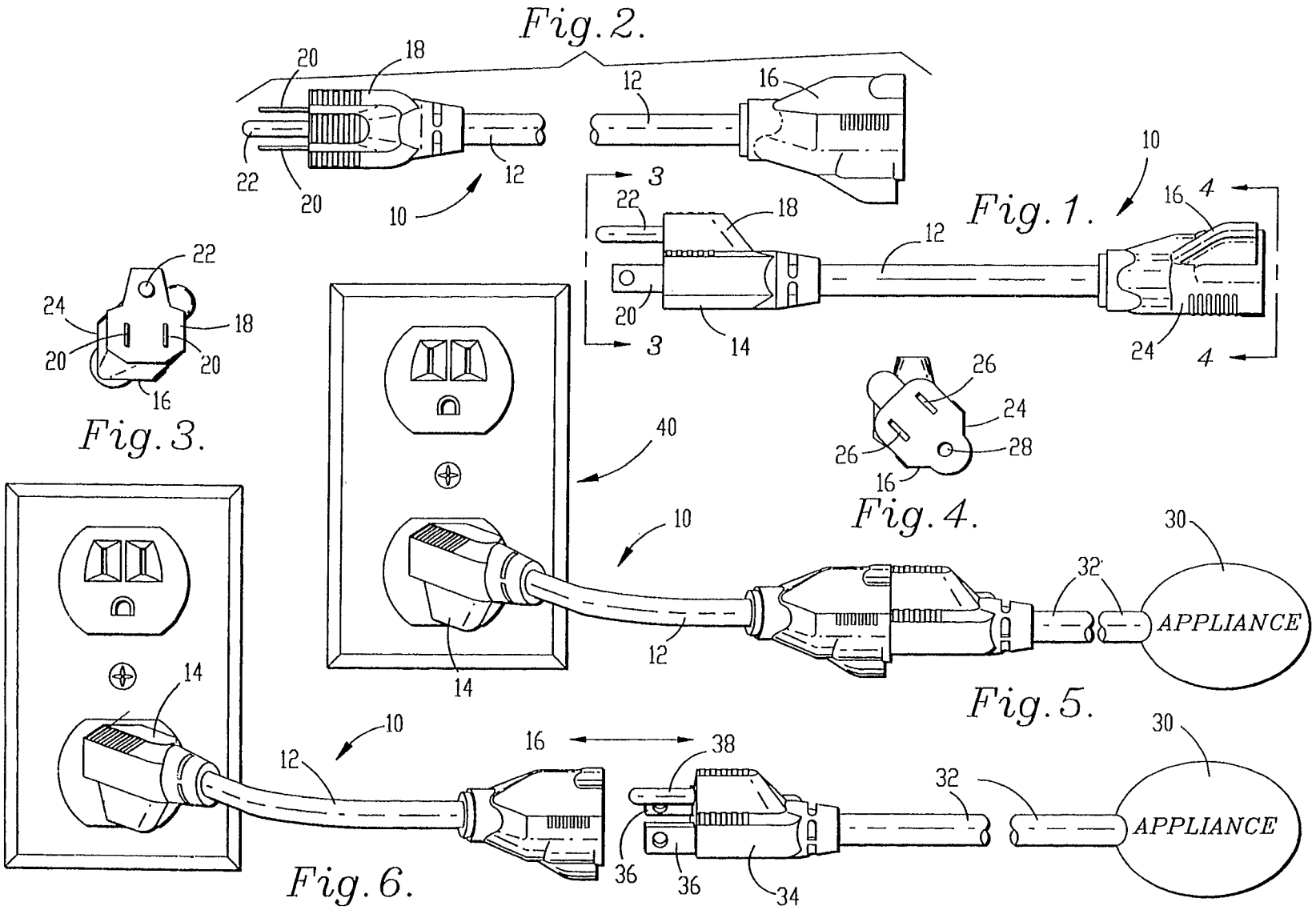
FIG. 1 is a side elevational view of the preferred short extension cord of the present invention.
FIG. 2 is a plan view of the cord of FIG. 1.
FIG. 3 is an end view taken along line 3—3 of FIG. 2 and depicting the male electrical connector end of the short extension cord.
FIG. 4 is an end view taken along line 4—4 of FIG. 2 and illustrating the female receptacle end of the short extension cord
FIG. 5 is an elevational view illustrating a mobile electrical appliance having a power cord, with the latter operatively connected with the short extension cord of the invention.
FIG. 6 is a view similar to that of FIG. 5, but illustrating the damage-preventing separation between the appliance power cord and the short extension cord of the invention.

Turning now to the drawings, and particularly FIGS. 1–4, it will be observed that a short extension cord 10 is provided having a short stretch 12 of conventional electrical cable, as well as a plug or male electrical connector 14 adjacent one end of the cable 12. The opposite end of cable 12 is equipped with a female electrical receptacle 16.

The cable 12 is of very short length, typically from about 1–9 inches, and preferably about 2–3 inches. The male electrical connector 14 is of the usual construction, and includes an enlarged molded body 18 with a pair of blade-type electrical contacts 20 as well as a grounding prong 22. As illustrated, male electrical connector 14 is of the nominal 120 volt variety commonly found in households and offices.

Female connection 16 is likewise of conventional, nominal 120 volt design and includes an enlarged molded body 24 with laterally spaced openings 26 and circular opening 28 for respectively receiving the blade-type contacts and prong of a mating male electrical plug or connector. As best seen in FIGS. 1–2, the male and female connectors 14, 16 are circumferentially offset from each other.

As illustrated in the drawings, the overall cord 10 is very short by conventional standards, and preferably has a total length of up to about 12 inches, and more preferably up to about 8 inches. It is also important that there be sufficient cable length between the inboard ends of the bodies 18 and 24 to permit essentially 360° rotation of the female connection end 16, when the male connection end 14 is inserted into a wall receptacle.

Attention is next directed to FIGS. 5 and 6, which illustrate the use of cord 10 with a mobile appliance 30, e.g., an electrically powered, nominal 120 volt carpet shampooer or floor sander. The appliance includes the usual elongated power cord 32 terminating in a nominal 120 volt male plug or appliance connector 34 of conventional design, i.e., including blade-type contacts 36 and grounding prong 38. As indicated previously, the power cord 32 is typically very long, and may have a length on the order of 25–100 feet.

In use, the male connector 14 of the short extension cord 12 is inserted into a typical wall-mounted outlet receptacle 40. Thereupon, the appliance male electrical connector 34 is inserted into female receptacle 16 of short extension cord 10, as illustrated in FIG. 5. At this point, use of appliance 30 proceeds in the usual fashion, with the proper electrical connection being made from receptacle 40 through short extension cord 10 and ultimately through power cord 32. Thus, in the preferred method and apparatus of the invention, the supplemental electrical connecting means between the normal appliance male plug 34 and receptacle 40 consists essentially of short extension cord 10.

In the event that the user of appliance 30 stretches power cord 32 and inadvertently creates an undue tension load on the cable 32, the short extension cord 10 turns and rotates as necessary owing to the flexibility of cord stretch 12, to maintain the female receptacle 16 and appliance male electrical connector 34 in substantial alignment. As a consequence, such undue tension loading will cause a separation between the appliance male electrical connector 34 and short extension cord female receptacle 16 as shown in FIG. 6. This occurs prior to any damage to the male electrical connector 14 forming a part of extension cord 10, or the stationary receptacle 40.

It will thus be appreciated that the user of short extension cord 10 completely eliminates the problem of damage to the appliance male electrical connector 34. Hence, the user of appliance 30 can proceed without fear that his own actions will damage the equipment. Provision of the short extension cord 10 having the preferred length of up to about 8 inches assures that the interconnection between female receptacle 16 and appliance male electrical connector 34 is maintained above floor level, i.e., normally wall receptacles 40 are positioned about 8 inches above floor level. This is advantageous in that this electrical connection remains elevated above the floor and any wetness attributable to the carpet shampooing operation As used herein, "nominal 120 volt" is intended to refer to conventional electrical cords and connectors used with typical household current. Such current ratings have been denominated as 110 volt, 115 volt, or more recently 120 volt, but for convenience, the term "nominal 120 volt" has been selected to refer to and cover all of these alternative designations.

I claim:

1. A method of coupling a mobile, electrically powered floor engaging appliance having an elongated electrical power cable terminating in an appliance male connector with a normal stationary electrical outlet receptacle in order to prevent significant damage to said appliance male connector in the event that an undue tension load is experienced by the power cable during movement of the appliance, said method comprising the steps of:

providing a short electrical extension cord presenting a stretch of flexible electrical cable, a female electrical receptacle operatively coupled with said extension cord at a first end of the cable, and an extension cord male electrical connector having a mating configuration with said female electrical receptacle at a said second end of the cable, said male electrical connector being adapted for insertion into said stationary electrical outlet receptacle, wherein said short extension cord has a maximum length of up to about 8 inches;

inserting said extension cord male electrical connector into said stationary outlet receptacle; and inserting said appliance male connector into said female electrical receptacle of said short extension cord, said appliance male connector being separable from said female electrical receptacle by an undue tension load that turns and twists said female electrical receptacle prior to separation of the extension cord male electrical connector from the stationary electrical outlet when the mobile, floor engaging appliance is pulled at an angle to the stationary electrical outlet receptacle under said undue tension load.

* * * * *